US005817909A

United States Patent [19]

Lescuyer et al.

[11] Patent Number: 5,817,909

[45] Date of Patent: Oct. 6, 1998

[54] PURIFICATION OF WASTE/INDUSTRIAL EFFLUENTS COMPRISING ORGANIC/ INORGANIC POLLUTANTS

[75] Inventors: Jean-Louis Lescuyer, Lyons; Francois Paquet, Ternay, both of France

[73] Assignee: Rhone-Poulenc Chimie, Courbevoie Cedex, France

[21] Appl. No.: 608,934

[22] Filed: Feb. 29, 1996

Related U.S. Application Data

[63] Continuation of Ser. No. 152,136, Nov. 16, 1993, abandoned.

[30] Foreign Application Priority Data

Nov. 16, 1992 [FR] France ..... 92 13734

[51] Int. Cl.[6] ..... A62D 3/00; F23M 3/04; C01B 17/52

[52] U.S. Cl. ..... 588/205; 588/240; 588/900; 423/210; 423/542; 423/659; 431/9; 431/10

[58] Field of Search ..... 423/245.1, 245.2, 423/245.3, 246, 210, 224, 456, 541 A, 542, 659; 110/264; 588/205, 900, 240; 431/9, 10

[56] References Cited

U.S. PATENT DOCUMENTS

| | | | |
|---|---|---|---|
| Re. 30,455 | 12/1980 | Henderson | 423/450 |
| 4,208,390 | 6/1980 | Hirabayashi et al. | 423/541.4 |
| 4,241,022 | 12/1980 | Kraus et al. | 423/457 |
| 4,316,878 | 2/1982 | Akuwe et al. | 423/235 |
| 4,526,529 | 7/1985 | Bernard | 431/9 |
| 4,931,012 | 6/1990 | Prudhon | 431/9 |
| 5,050,512 | 9/1991 | Tratz et al. | 110/346 |

FOREIGN PATENT DOCUMENTS

| | | |
|---|---|---|
| 0042331 | 12/1981 | European Pat. Off. . |
| 0128792 | 12/1984 | European Pat. Off. . |
| 0232658 | 8/1987 | European Pat. Off. . |
| 2257326 | 8/1975 | France . |
| 2431321 | 2/1980 | France . |
| 2551183 | 3/1985 | France . |
| 3004186 | 8/1980 | United Kingdom . |

*Primary Examiner*—Gary P. Straub
*Attorney, Agent, or Firm*—Burns, Doane, Swecker & Mathis, L.L.P.

[57] ABSTRACT

Waste/industrial effluents containing contaminating amounts of organic and/or inorganic species, for example effluents containing sulfate or sulfuric acid values, or effluents emanating from the production of methionine, are safely and effectively purified in high yield, by first establishing, in a first reaction zone, an axially helically descending flowstream defining a phase of combustion, this phase of combustion comprising ignited admixture of a first oxidizing fluid and a combustible fuel; ejecting the phase of combustion through a port of restricted flow passage to impart an axially symmetrical vortex flow thereto and flash-expanding same into a second reaction zone; introducing effluent to be purified into the axially symmetrical vortex thus formed; and also introducing additional oxidizing fluid into such axially symmetrical vortex, whereby the effluent is disintegrated into a multitude of droplets entrained in unit volumes of the phase of combustion and thermally treated in the second reaction zone.

14 Claims, 2 Drawing Sheets

PURIFICATION OF WASTE/INDUSTRIAL EFFLUENTS COMPRISING ORGANIC/ INORGANIC POLLUTANTS

This application is a continuation, of application Ser. No. 08/152,136 filed Nov. 16, 1993, now abandoned.

BACKGROUND OF THE INVENTION

1. Field of the Invention

The present invention relates to the purification of waste and industrial effluents comprising polluting organic materials and/or inorganic compounds to provide clean effluents devoid of such pollutants which are even recyclable.

This invention especially relates to the purification of industrial effluents emanating from the production of methionine.

2. Description of the Prior Art

It is known to this art that the chemical industry conducts numerous and varied processes that produce waste streams or effluents comprising polluting organic impurities. For obvious reasons linked to preservation of the environment, these effluents cannot be discarded or disposed of without being purified. Further, in certain instances, these effluents may contain, either alone or in combination with the organic pollutants, inorganic chemical species which can usefully be recovered. In such cases, it is advantageous, for process economy, to permit treating the effluents such that the subject chemical species are sufficiently devoid of impurities as to be recoverable, or that the effluents can optionally be recycled into the process (given their purity after treatment).

Among the known processes for the purification/ treatment of effluents comprising organic impurities and/or inorganic compounds, certain of which entail a combustion or incineration of these impurities, or a thermal treatment of the inorganic compounds. The effluents are, for example, introduced into static vertical ovens or incinerators where they are atomized into a stream of hot gases resulting from the combustion of, e.g., a fuel oil/air mixture. The problem with this type of process is that the gas/liquid contacts are initiated in a completely random manner, given the respective flowpaths of the gases and the liquid. This presents the essential consequence of permitting only an imperfect or incomplete combustion, or thermal treatment, of the organic materials or the inorganic compounds, respectively. As regards combustion, the destruction or consumption yields generally range from 96% to 98%, which may be inadequate with respect to current environmental standards.

The known processes may also present other problems, especially in the case of effluents comprising salts as inorganic compounds, such as, for example, sodium sulfate. In this instance, when the melting point of these salts is reached, they can settle on the apparatus, thus presenting risks of dirt accumulation and clogging of the assembly/ installation, which risks are accentuated by the corrosive nature of certain salts such as, in particular, sodium sulfate.

Serious need therefore continues to exist for a purification technique whose efficiency is improved relative to existing such processes and which can safely be carried out.

SUMMARY OF THE INVENTION

Accordingly, a major object of the present invention is the provision of a safe and improved technique for the purification of waste/industrial effluents containing organic or inorganic impurities, or mixtures thereof.

Briefly, the present invention features the thermal purification of a waste/industrial effluent containing contaminating amounts of organic and/or inorganic species, which comprises establishing, in a first reaction zone, an axially helically descending flowstream defining a phase of combustion, said phase of combustion comprising ignited admixture of a first oxidizing fluid and a combustible fuel; ejecting said phase of combustion through a port of restricted flow passage to impart an axially symmetrical vortex flow thereto and flash-expanding same into a second reaction zone; introducing effluent to be purified into said axially symmetrical vortex; and also introducing additional oxidizing fluid into said axially symmetrical vortex, whereby said effluent is disintegrated into a multitude of droplets entrained in unit volumes of the phase of combustion and thermally treated in said second reaction zone.

DETAILED DESCRIPTION OF PREFERRED EMBODIMENTS OF THE INVENTION

Figure 1:
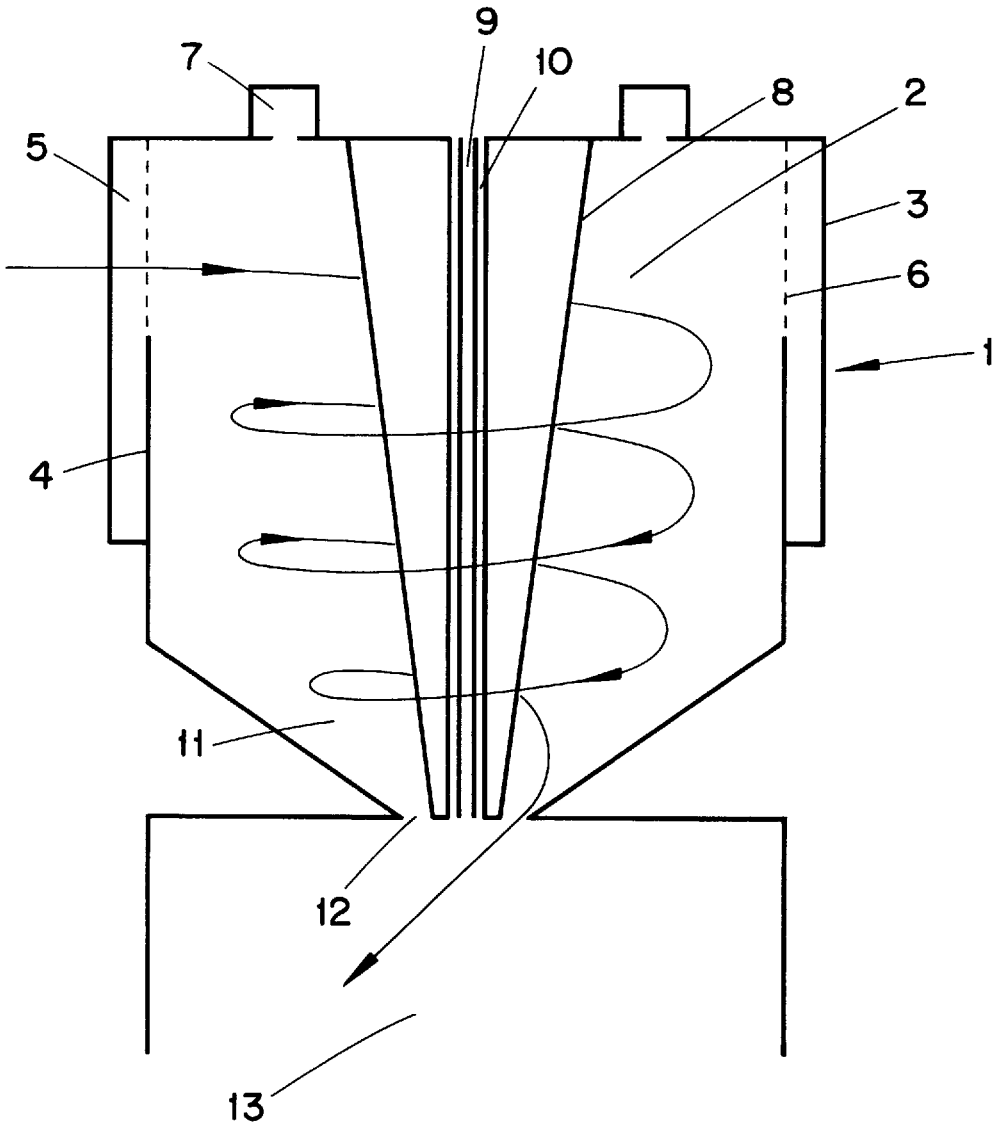
FIG. 1 is a cross-sectional, front elevational view of a burner/incinerator useful for the purification technique according to the present invention.

More particularly according to the present invention, yields of impurity consumption/destruction substantially greater than 98% are attained, for example of at least 99% and even of at least 99.9%.

The process of the invention can be used for purifying any type of liquid or gaseous effluent. It is most particularly suitable for purifying liquid effluents.

It is primarily applicable to effluents containing polluting impurities or organic materials which are combustible or degradable at elevated temperatures. The process is especially suitable in the event that the impurities contained in the effluent are sulfur-containing organic species.

The process of the invention is also particularly suitable for purifying effluents comprising an inorganic compound whose recovery or recycling is desirable. Exemplary such effluents contain a sulfate, notably an alkali metal sulfate such as sodium sulfate, or, alternatively, residual sulfuric acids.

Of course, the process of the invention is most particularly useful for the purification of effluents containing both organic materials and inorganic compounds.

The process of the invention may thus be used for the treatment/purification of effluents deriving from the production of amino acids comprising sulfur. One specific example is thus the treatment/purification of effluents emanating from the production of methionine, and, especially, of mother liquors from the crystallization of the latter. In this latter instance, the effluent to be treated comprises, in addition to sodium sulfate, numerous organic impurities such as methionine degradation compounds having one or more sulfur atoms. Further, the gases deriving from the combustion treatments of the type described above comprise a large amount of sulfur-containing products.

Another example of effluents efficiently purified by the process of the invention, are those resulting from the production of certain esters via sulfuric catalysis, such as ethyl phthalate or, alternatively, the crystallization mother liquors from the preparation of itaconic acid.

The purification process of the invention will now be more fully described.

The first stage of the process entails producing a combustion phase under specific conditions. Thus, a first oxidizing fluid and a combustible fluid are introduced into a first zone.

Generally, these two fluids are in gaseous state. Air, optionally enriched with oxygen, is advantageously used as the first oxidizing fluid. The combustible fluid may be a gas such as methane or propane, or a light hydrocarbon, for example. Natural gas is advantageously used.

Furthermore, according to one characterizing parameter of the invention, at least one of these two fluids, generally the oxidizing fluid, is introduced into the aforementioned zone along an axially descending helical path. This fluid is introduced with a slight excess of pressure relative to the pressure existing downstream in the second zone. This excess pressure is generally at most 1 bar and preferably ranges from 0.2 to 0.5 bar.

Combustion of the fuel and the oxidant is initiated to thus provide, in said first zone, a combustion phase which itself is transported along a helical path.

This phase is then transferred into a second zone through a port of restricted or narrow passage such as to impart thereto a vortex flow along an axis of symmetry. This vortex flow indeed corresponds to travel of the gases along a set of paths defined by families of generators of a hyperboloid. These generators are situated on a plurality of circles located near and below the port of narrow passage, before diverging/expanding in all directions in the second zone.

It will be appreciated that following this movement, there is created in a zone of axial symmetry relative to the path of the gases, a relative depression with respect to the remainder of the first zone. By "zone of axial symmetry" is intended the zone extending in the vicinity of the axis of symmetry of the aforesaid path.

The effluent to be treated is introduced into the zone of axial symmetry of the vortex flow. Preferably, this introduction is carried out axially.

Also preferably, the site of introduction is situated in the immediate vicinity of the port of narrow passage, upstream of the latter or at the exact level thereof.

In another characterizing parameter of the invention, a second oxidizing fluid is also introduced into the aforesaid axial zone. The above description respecting the site of introduction of the effluent is also applicable to the inlet of the second oxidizing fluid. Preferably, this introduction is also carried out axially. Further, in one preferred embodiment of the invention, the effluent and the second oxidant are introduced coaxially.

Pure oxygen is a preferred "second oxidant." Oxygen/inert gas mixtures can also be used.

Given the depression effect in the zone for introducing the effluent, the latter is aspirated and then, following a transfer of momentum between the effluent and the combustion phase, it is pulverized or disintegrated. There is thus obtained, at the inlet of the second zone, an isodistributed and practically instantaneous dispersion into a spectrum of fine particles which will then be vaporized in a homogeneous and rapid fashion.

In actual practice, the effluent is introduced at a low initial rate, preferably of less than 10 m/s and more preferably less than 5 m/s such as to not increase too much the initial momentum of the combustion phase, the ratio of the momentums of these two elements being at least equal to 100, preferably ranging from 1,000 to 10,000.

Moreover, the procedure is carried out under conditions such that the temperature attained by the effluent, after vaporization, is greater than its ignition temperature.

Contacting of the combustion phase with the effluent is more particularly described in French Patents Nos. 2,257,326; 2,431,321 and 2,551,183, hereby expressly incorporated by reference.

The contacting of the vaporized effluent with the second oxidizing fluid will initiate, in the second zone, the combustion or the degradation of the organic impurities, as well as a thermal treatment of the inorganic compounds, such as a drying, a melting, a thermal decomposition, and the like.

At the outlet of this second zone, a second, essentially gaseous, phase is obtained, but which may comprise a liquid and/or a solid, which is treated in a manner known per se in order to recover the compounds which can be upgraded and to ensure compliance with discharge standards.

This second phase may thus be scrubbed or soaked. It can also be cooled to permit recovery of the solids content on a filter.

The gases may lastly be treated by spraying with any suitable liquid to remove residual impurities or products of combustion prior to discharge, for example to absorb the sulfur-containing species such as $SO_2$.

The present invention will now be more fully described with reference to the accompanying Figures of Drawing.

FIG. 1 illustrates a burner 1 comprising a combustion chamber 2.

This combustion chamber 2 comprises an external cylinder 3 and a coaxial internal cylinder 4, thus defining a central zone and an annular peripheral zone 5 having perforations 6 distributed over a plurality of axially spaced circles thereon. The upper end of the chamber 2 also comprises an inlet 7 for introducing the combustible fluid.

The combustion chamber 2 is additionally provided, at its axial upper end, with a liquid or gas inlet 8 comprising two coaxial tubes 9 and 10 surrounded by an insulating packing and defining means for the introduction of the effluent to be treated and the second oxidizing fluid, respectively.

The chamber 2 terminates into a mixer head 11 defining a neck 12 permitting transfer into a second zone 13. It will be appreciated that in the embodiment represented, the inlet 8 opens exactly at the neck 12 and is situated on the axis of symmetry of the latter.

The burner described above operates as follows. The first oxidizing fluid is introduced via an inlet orifice (not shown) provided in the annular zone. It penetrates into the zone 2 via the perforations 6 and then axially downwardly descends along the helical path represented in FIG. 1. It mixes with the fuel and the admixture is ignited by any known means, for example by a spark plug (not shown), between the electrodes of which a spark is generated.

It is during the passage through the neck 12 or port of restricted flow passage that the vortex movement or flow described above is imparted to the combustion phase.

The effluent is introduced via inlet 9 and contacts the combustible phase essentially exactly at the level of the neck 12 where it is then fractionated or disintegrated into a multitude of drops, each of which being transported by or entrained in a unit volume of the gaseous combustion phase.

Figure 2:
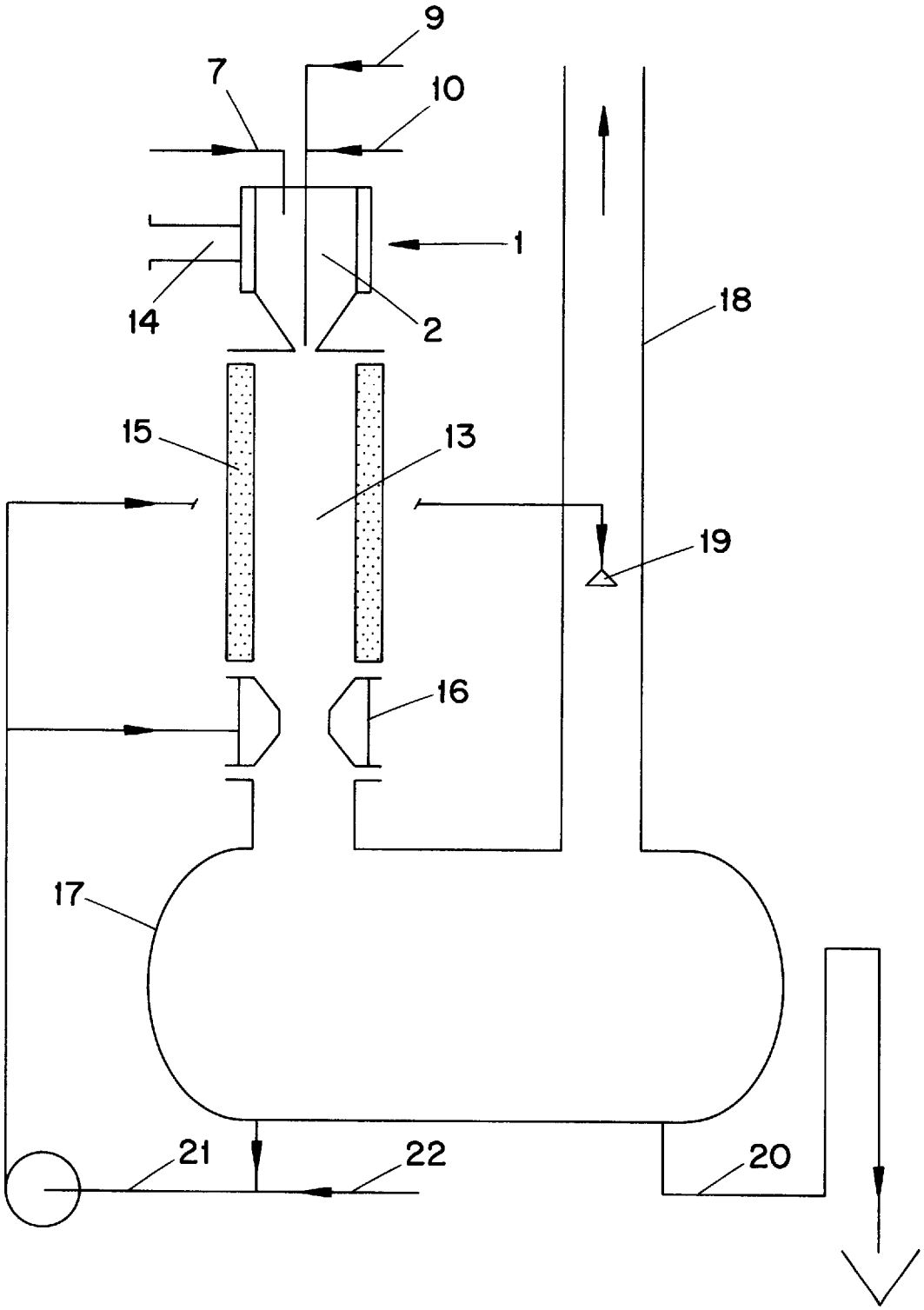
FIG. 2 is a schematic/diagrammatic illustration of the purification technique according to the invention, using the burner/incinerator shown in FIG. 1.

FIG. 2 illustrates a complete assembly for carrying out the process of the invention. Included is a burner of the same type as that described above, the conduit 14 representing the oxidant inlet tube.

Downstream of the burner 1, the second zone 13 comprises an oven 15 having refractory walls. This oven downwardly communicates into a soaking device 16, for example soaking means comprising a water-spray ring.

The apparatus comprises, in addition, a tank 17 for receiving and separating the liquid and the gases. The latter exit the installation via the chimney or stack 18 which is equipped with a spraying device 19. The effluent is collected via an outlet drain 20. It may be partially recycled via a conduit 21 to the soaking device 16 and/or to a spray for the gases. Inlet conduit 22 provides means to supply an additional amount of water to the assembly.

In order to further illustrate the present invention and the advantages thereof, the following specific example is given, it being understood that same is intended only as illustrative and in nowise limitative.

EXAMPLE

The apparatus used was that illustrated in the Figures of Drawing.

An effluent was introduced via inlet 9 and comprised methionine crystallization mother liquors having the following composition by weight: sodium sulfate ($Na_2SO_4$), 18–22%; methionine, 2–2.5%; organic compounds, 5–15%. The purifications were conducted on batches having a total organic carbon content (TOC) of 45 to 80 g/l. High-pressure air at 0.5 bar was supplied via line 14, methane via line 7 and oxygen via line 10.

The respective flow rates were the following:

| | Air | Methane | Oxygen | Effluent |
|---|---|---|---|---|
| Flow rate | 695 kg/h | 2.23 kmol/h | 42 $Nm^3/h$ | 210 kg/h |

In addition, the temperature at the base of the soaking device 16 was 88° C. and that at the bottom of the oven 13 was 1,100° C., which, after calculation, provided a temperature in the neck 12 of 1,400° C. and a flame temperature for the methane at the base of the burner of 1,680° C., taking account of the thermal losses in the assembly.

Analyses provided the following results:

| | Effluent (a) | Drain (20) (b) | Gas (c) |
|---|---|---|---|
| TOC g/h | 8,536 | 1.91 | 1.05 |

An unconsumed total in TOC g/h d=b+c of 2.96 and, therefore, a yield (a–d)/a of 99.965%, as well as a liquid yield (a–c)/a of 99.978%, were obtained. Too, the fumes emitted were odorless.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for thermally treating waste/industrial effluent containing contaminating amounts of organic, inorganic, or organic and inorganic species, which comprises establishing, in a first reaction zone, an axially helically descending flowstream of hot combustion gas; ejecting said combustion gas through a port of restricted flow passage to impart an axially symmetrical vortex flow thereto and flash-expanding same into a second reaction zone; introducing effluent and additional oxidizing fluid into said second reaction zone and contacting said effluent with said vortex to convert it into a multitude of droplets entrained in said combustion gas; and thermally treating the resultant mixture in said second reaction zone to provide a product effluent having a lower amount of said contaminating species, wherein both said effluent to be purified and said additional oxidizing fluid are axially introduced into said axially symmetrical vortex.

2. The process as defined by claim 1, comprising coaxially introducing said effluent and said additional oxidizing fluid into said axially symmetrical vortex.

3. The process as defined by claim 1, wherein said effluent comprises a contaminating amount of an inorganic sulfate.

4. The process as defined by claim 1, wherein said effluent comprises a contaminating amount of sulfuric acid.

5. The process as defined by claim 1, wherein said effluent comprises a contaminating amount of organosulfur values.

6. The process as defined by claim 1, wherein said effluent emanates from the production of methionine.

7. The process as defined by claim 6, said effluent to be purified comprises mother liquors from the crystallization of methionine.

8. The process as defined by claim 1, wherein the ratio of the momentum of the phase of combustion to that of the effluent to be purified is at least 100 at the point of introduction of the effluent.

9. The process as defined by claim 8, said ratio ranging from 1,000 to 10,000.

10. The process as defined by claim 1, comprising scrubbing the phase of combustion from said second reaction zone.

11. The process as defined by claim 1, said additional oxidizing fluid comprising oxygen gas.

12. The process as defined by claim 1, wherein greater than 98% of said contaminating species are destroyed.

13. The process as defined by claim 12, wherein at least 99% of said contaminating species are destroyed.

14. The process as defined by claim 13, wherein at least 99.9% of said contaminating species are destroyed.

* * * * *